US006528468B2

(12) United States Patent
Matsukawa et al.

(10) Patent No.: US 6,528,468 B2
(45) Date of Patent: Mar. 4, 2003

(54) PICKLING AGENT FOR THE CHEMICAL CONVERSION COATING OF HEAT EXCHANGER, METHOD OF PICKLING HEAT EXCHANGER

(75) Inventors: Masahiko Matsukawa, Tokyo (JP); Kentaro Saito, Kawasaki (JP); Toshio Inbe, Yokohama (JP); Kasuyoshi Yamasoe, Sakura (JP)

(73) Assignee: Nippon Paint Co., Ltd., Osaka (JP)

( * ) Notice: Subject to any disclaimer, the term of this patent is extended or adjusted under 35 U.S.C. 154(b) by 0 days.

(21) Appl. No.: 09/726,420

(22) Filed: Dec. 1, 2000

(65) Prior Publication Data

US 2001/0018965 A1 Sep. 6, 2001

(30) Foreign Application Priority Data

Dec. 1, 1999 (JP) ..... 11-341893

(51) Int. Cl.[7] ..... C11D 7/08; C11D 7/10

(52) U.S. Cl. ..... 510/258; 510/202; 510/245; 510/253; 510/234; 510/254; 134/3; 165/95; 165/148

(58) Field of Search ..... 510/202, 245, 510/253, 234, 254, 258; 134/3; 165/95, 148

(56) References Cited

U.S. PATENT DOCUMENTS 3,785,866 A * 1/1974 Frey ..... 134/3
4,707,191 A * 11/1987 Martinou et al. ..... 134/3
4,851,148 A * 7/1989 Yamasoe et al. ..... 252/142
5,030,323 A * 7/1991 Awad ..... 156/665
5,234,714 A * 8/1993 Patel et al. ..... 427/327
5,514,293 A * 5/1996 Shimakura et al. ..... 252/79.2
5,688,755 A * 11/1997 Ikeda et al. ..... 510/254
6,083,896 A * 7/2000 Inbe et al. ..... 510/254

* cited by examiner

*Primary Examiner*—Charles Boyer
(74) *Attorney, Agent, or Firm*—Connolly Bove Lodge & Hutz LLP

(57) ABSTRACT

The present invention relates to a pickling agent for the chemical conversion coating of a heat exchanger which is capable of cleaning the complicated structure comprising fins and tubes of a heat exchanger in preparation for the successful formation of a chemical conversion film, a method of pickling a heat exchanger, a method of treating a heat exchanger comprising said pickling method, and a heat exchanger produced by using said treating method.

The present invention provides pickling agent for the chemical conversion coating of a heat exchanger which comprises an acidic aqueous solution containing nitric acid and/or sulfuric acid and at least one metal and/or metal oxoanion salt derived from any metal selected from the group consisting of iron, nickel, cobalt, molybdenum and cerium.

11 Claims, No Drawings

PICKLING AGENT FOR THE CHEMICAL CONVERSION COATING OF HEAT EXCHANGER, METHOD OF PICKLING HEAT EXCHANGER

TECHNICAL FIELD

The present invention relates to a pickling agent for the chemical conversion coating of a heat exchanger which is capable of cleaning the complicated structure comprising fins and tubes of a heat exchanger in preparation for the successful formation of a chemical conversion film, a method of pickling a heat exchanger, a method of treating a heat exchanger comprising said pickling method, and a heat exchanger produced by using said treating method.

PRIOR ART

The heat exchanger component of a car evaporator, a room conditioner or the like has a complicated structure comprising aluminum fins for heat exchange as arranged at close spaces and aluminum tubes for feeding a refrigerant to said fins as assembled in an intricate geometric relation. The assembling of the tubes and fins is made by brazing in many instances. The hard solder used for brazing includes aluminum-silicon alloy and aluminum-silicon-magnesium alloy, among others, and is sometimes referred to as brazing material.

The metallic segregates derived from the hard solder such as aluminum-silicon alloy or the like make it difficult to form a satisfactory chemical conversion film with a chemical conversion coating agent. In order to have a tough chemical conversion coating film on an aluminum member with good adhesion, said segregates must be somehow removed in advance. However, removing said segregates, an aluminum oxide film tends to be formed on the surface or the hard solder aluminum-silicon alloy or the like tends to be segregated and be intimately stuck to the surface.

The oxide may be removed by cleaning with an acid, an alkali or a surfactant but it is difficult to remove the segregates sufficiently. Since the residual segregates are not receptive to a chemical conversion coating, the corrosion resistance of the product is decreased and the white rust consisting in aluminum oxide forms on the fins and tubes to favor aging of the heat exchanger. Furthermore, the white rust absorbs moisture and the fungi which grow on the resulting stagnant water are scattered by the blower fan into the room or car compartment to become a source of malodor.

To overcome the above disadvantage, Japanese Kokai Publication Hei-11-131254, for instance, proposes chemical etching with an acidic aqueous solution containing at least one member selected from the group consisting of sulfuric acid, hydrofluoric acid, nitric acid and phosphoric acid. However, this treatment is not effective in cleaning the aluminum fins and the like thoroughly and the car evaporator even after chemical conversion treatment and hydrophilic treatment is found to be still liable to develop white rust under prolonged salt-spray test conditions.

The corrosion resistance of an aluminum heat exchanger should be remarkably improved if a chemical conversion coating film could be formed intimately and uniformly on the aluminum fins and tubes. For this purpose, it is necessary to thoroughly remove the segregates and clean the aluminum surface in a stage preceding the chemical conversion treatment.

Therefore, the object of the present invention is to provide a pickling agent for the chemical conversion coating of a heat exchanger which is capable of removing the segregates derived from the hard solder and clean the heat exchanger fins and tubes of aluminum thoroughly to enable formation of a satisfactory chemical conversion film, a method of pickling a heat exchanger with said pickling agent, a method of treating a heat exchanger which comprises said pickling method, and a heat exchanger obtainable by using said treating method.

SUMMARY OF THE INVENTION

Designed to solve the above problem, the pickling agent for the chemical conversion coating of a heat exchanger according to the present invention comprises an acidic aqueous solution containing nitric acid and/or sulfuric acid and at least one metal and/or metal oxoanion salt derived from any metal selected from the group consisting of iron, nickel, cobalt, molybdenum and cerium.

The method of pickling a heat exchanger according to the present invention comprises bringing a pickling agent into contact with a heat exchanger comprising aluminum material under the conditions of 10 to 70° C. and 0.5 to 5 minutes, said pickling agent comprising an acidic aqueous solution containing nitric acid and/or sulfuric acid and 0.01 to 5 mass % of at least one metal and/or metal oxoanion salt derived from any metal selected from the group consisting of iron, nickel, cobalt, molybdenum and cerium.

Referring to the metal component of said metal salt, the highest corrosion resistance can be obtained when both of iron and cerium are contained in the pickling agent but a high corrosion resistance not obtainable by the prior art can still be expressed by having at least one of said metal species contained in the pickling agent. As to examples of said metal salt, there can be mentioned the sulfate, nitrate, acetate and hydrochloride. As examples of said metal oxoanion salt, there can be mentioned molybdates. Furthermore, the preferred addition amount of said metal and/or metal oxoanion salt is 0.01 to 5 mass % in the pickling agent. A specific example of the heat exchanger is a car evaporator made of aluminum and this invention is particularly useful for the pickling of a car evaporator having brazed joints.

The method of treating a heat exchanger according to the present invention comprises, following said pickling, forming a chemical conversion film and further forming a hydrophilic coating film, and the heat exchanger of the present invention is produced by using the above method.

DETAILED DESCRIPTION OF THE INVENTION

The present invention is now described in detail.

The pickling agent and the pickling method using the same, both provided in accordance with the present invention, are applied to a heat exchanger comprising aluminum material such as aluminum metal and an aluminum alloy. The pickling agent is an acidic aqueous solution of nitric acid and/or sulfuric acid supplemented with at least one metal and/or metal oxoanion salt derived from any metal selected from the group consisting of iron, nickel, cobalt, molybdenum and cerium. The metal salt specifically includes iron sulfate (ferrous and ferric salts are included; the same applies hereinafter), ammonium iron sulfate, potassium iron sulfate, nickel sulfate, cobalt sulfate, ammonium cobalt sulfate, cerium sulfate, ammonium cerium sulfate, iron nitrate, cobalt nitrate, nickel nitrate, cerium nitrate, iron acetate, nickel acetate, cobalt acetate, cerium acetate, iron chloride, nickel chloride, cobalt chloride, molybdenum chloride and cerium chloride. The metal oxoanion salt includes ammonium molybdate, potassium molybdate and sodium molybdate, among others. Among these salts, the use of an iron salt and a cerium salt, for example iron sulfate and cerium sulfate, is particularly effective.

The amount of said metal and/or metal oxoanion salt in said aqueous solution is preferably 0.01 to 5 mass %, more preferably 0.1 to 1 mass %. When the amount of said metal and/or metal oxoanion salt is less than 0.01 mass %, the segregates-scavenging effect of the pickling agent may not be fully expressed. When the amount exceeds 5 mass %, an increased burden is imposed on pickling so that it is economically not acceptable. On the other hand, sulfuric acid and/or nitric acid should only be used in a sufficient amount to adjust the pickling solution to a pH not over 2 but these acids are preferably used together and a still further improvement in pickling effect can be obtained when the sulfuric acid/nitric acid mass ratio is within the range of 25/75 through 75/25.

The method of pickling a heat exchanger according to the present invention comprises either spraying the aluminum member with a pickling agent of the above formulation or dipping the member in a pickling bath of the same formulation. The temperature of the pickling agent is preferably 10 to 70° C. and the contact time is preferably 0.5 to 5 minutes. When the liquid temperature is lower than 10° C. or the contact time is less than 30 seconds, the removal of segregates may not be thorough. When the upper limit of 70° C. or the upper limit of 5 minutes is exceeded, the aluminum member tends to be overetched.

Following the above pickling procedure, the aluminum member is cleaned with water and then subjected to chemical conversion treatment. The chemical conversion reagent which can be used includes the various known reagents, e.g. the so-called chromate types such as chromic acid-chromate type and chromate-phosphate type and the so-called chromium-free reagents such as a zirconium salt, a titanium salt, a silicon salt, a boron salt or a permanganate salt, inclusive of the fluorides thereof, or a combination of any of these compounds with phosphoric acid, manganic acid, permanganic acid, vanadic acid, tungstic acid or molybdic acid. After formation of the chemical conversion coating film, the work is cleaned with water again and a hydrophilic coating is applied and dried. The hydrophilic coating which can be used for the formation of a hydrophilic coating film may for example be a composition containing a hydrophilic polymer or monomer of carboxymethylcellulose or its sodium salt, potassium salt or ammonium salt, polyvinyl alcohol, N-methylolacrylamide, polyacrylic acid, or polyethylene oxide, for instance. For improving the performance of the hydrophilic coating film, it is good practice to use additives such as zirconium compounds.

Despite its complicated structure comprising thin-wall fins and tubes arranged at close spaces, the car evaporator treated as above has been sufficiently cleaned of the segregates and has a chemical conversion film intimately secured to its aluminum surface. In addition, it has a hydrophilic coating film further superimposed in intimate contact. Therefore, the corrosion resistance of the heat exchanger has been improved to the extent not achieved by the prior art, with the result that the heat exchanger does not appreciably develop white rust even if it is operated over a long time. Containing at least one metal and/or metal oxoanion salt derived from any metal selected from among iron, nickel, cobalt, molybdenum and cerium, the heat exchanger pickling agent of the present invention is capable of scavenging the hard solder-derived segregates thoroughly even when the heat exchanger has a complicated structure comprising thin-walled fins and tubes at close spaces. Therefore, a chemical conversion film can be formed on the aluminum member with good adhesion to effectively prevent development of white rust. This incidence of white rust can be further reduced by using iron and cerium in combination as the metal component.

The heat exchanger of the present invention has been first pickled with the above pickling agent and then treated with a chemical conversion coating and a hydrophilic coating in succession, with the result that not only the incidence of white rust is low but the adhesion of the hydrophilic coating is high.

EXAMPLES

The following working and comparative examples illustrate the present invention in further detail.

Example 1

Nitric acid and sulfuric acid were dissolved in water at final concentrations of 10 mass % and 5 mass %, respectively, followed by addition of molybdenum sulfate at 1 mass % to prepare a pickling solution. In a bath comprising the pickling solution warmed at 65° C., a car evaporator was immersed for 4 minutes, then taken out, and cleaned thoroughly with tap water. This car evaporator was further immersed in a similarly warmed bath of the zirconium conversion reagent at 65° C. for 4 minutes and, then, cleaned thoroughly with tap water. The car evaporator was then dipped in a polyvinyl alcohol type hydrophilic coating ["Surfal Coat 860R", Nippon Paint] and dried by heating at an ultimate temperature of 180° C. for 5 minutes, whereby a finished car evaporator having a hydrophilic coating film was obtained.

The corrosion resistance of the above car evaporator was evaluated by the 5% salt-spray test (240 hr) in accordance with JIS Z 2371 and the incidence of white rust was investigated. The composition of the pickling solution used and the result of the corrosion resistance test are shown in Table 1. The incidence of white rust shown is a visual inspection of the percentage of white rust formed on the exterior surface of the car evaporator.

Examples 2 to 9

Except that the kind and addition amount of metal salt were altered, car evaporators were treated in the same manner as in Example 1. The compositions of pickling agents used and the results of the corrosion resistance test are shown in Table 1.

Comparative Example 1

Except that no metal salt was added, the car evaporator was treated in the same manner as in Example 1. The result is shown in Table 1.

Comparative Example 2

Except that 0.5 part of hydrofluoric acid was added in lieu of the metal salt, the car evaporator was treated in the same manner as in Example 1. The result is shown in Table 1.

| | Composition of pockling solution (mass parts) | | | | | | Corrosion resistance |
|---|---|---|---|---|---|---|---|
| | Nitric acid | Sulfuric acid | Metal salt 1 Kind | Metal salt 1 Amount | Metal salt 2 Kind | Metal salt 2 Amount | (incidence of white rust) |
| Ex. 1 | 10 | 5 | Molybdenum sulfate | 1 | — | — | 10% |
| Ex. 2 | 10 | 5 | Nickelic sulfate | 1 | — | — | 10% |
| Ex. 3 | 10 | 5 | Ferric sulfate | 1 | — | — | 5% |
| Ex. 4 | 10 | 5 | Ceric sulfate | 1 | — | — | 10% |
| Ex. 5 | 10 | 5 | Ferric nitrate | 1 | — | — | 10% |
| Ex. 6 | 0 | 5 | Ferric sulfate | 1 | — | — | 10% |
| Ex. 7 | 10 | 5 | Ferric sulfate | 0.01 | — | — | 15% |
| Ex. 8 | 10 | 5 | Ferric sulfate | 3 | — | — | 5% |
| Ex. 9 | 10 | 5 | Ferric sulfate | 1 | Ceric sulfate | 1 | 3% |
| Compar. Ex. 1 | 10 | 5 | — | 1 | — | — | 30% |
| Compar. Ex. 2 | 10 | 5 | Hydrofluoric acid | 0.5 | — | — | 30% |

It will be apparent from Table 1 that with the pickling solutions according to the examples, the incidence of white rust after 240 hours of salt spray could be reduced to 10% or less and that the incidence was further reduced to 5% when iron (II) sulfate was added and to 3% when iron (II) sulfate and cerium (II) sulfate were used in combination, indicating that an outstanding corrosion resistance can be obtained in accordance with the present invention.

What is claimed is:

1. A pickling agent for the chemical conversion coating of a heat exchanger which consists of;

an acidic aqueous solution consisting of nitric acid and/or sulfuric acid and iron and/or oxoanion salt thereof;

and cerium and/or oxoanion salt thereof.

2. The pickling agent for the chemical conversion coating of a heat exchanger according to claim 1 wherein said oxoanion salt comprises a member selected from the group consisting of sulfate, nitrate, acetate and hydrochloride.

3. The pickling agent for the chemical conversion coating of a heat exchanger according to claim 1 which contains 0.01 to 5 mass % of said iron and cerium or oxoanion salts thereof.

4. The pickling agent for the chemical conversion coating of a heat exchanger according to claim 1 wherein the heat exchanger is a car evaporator.

5. The pickling agent for the chemical conversion coating of a heat exchanger according to claim 4 wherein the car evaporator has brazed joints.

6. A method for pickling a heat exchanger which comprises bringing the pickling agent of claim 1 into contact with a heat exchanger comprising aluminum material under the conditions of 10 to 70° C. and 0.5 to 5 minutes.

7. The method for pickling a heat exchanger according to claim 6 wherein said oxoanion salt is any of the sulfate, nitrate, acetate and hydrochloride.

8. The method for pickling a heat exchanger according to claim 6 wherein the heat exchanger is a car evaporator.

9. The method for pickling a heat exchanger according to claim 8 wherein the car evaporator has brazed joints.

10. A method of treating a heat exchanger which comprises, following pickling by the pickling method according to claim 6, forming a chemical conversion coating film and further forming a hydrophilic coating film in superimposition.

11. A heat exchanger as produced by using the method according to claim 10.

* * * * *

UNITED STATES PATENT AND TRADEMARK OFFICE

CERTIFICATE OF CORRECTION

PATENT NO. : 6,528,468 B2
DATED : March 4, 2003
INVENTOR(S) : Masahiko Matsukawa et al.

It is certified that error appears in the above-identified patent and that said Letters Patent is hereby corrected as shown below:

Title page,
Item [75], Inventors, should read:

-- Masahiko Matsukawa, Tokyo (JP);
Kentaro Saito, Kawasaki (JP); Toshio Inbe, Yokohama (JP); Katsuyoshi Yamasoe, Sakura (JP) --

Signed and Sealed this

Twenty-sixth Day of August, 2003

JAMES E. ROGAN
*Director of the United States Patent and Trademark Office*